United States Patent [19]

Blaskowski

[11] Patent Number: 4,511,371

[45] Date of Patent: Apr. 16, 1985

[54] METHOD FOR PREVENTING PLUGGING OF A SLAG OUTLET IN A SUBSTOICHIOMETRIC SLAGGING COMBUSTOR

[75] Inventor: Henry J. Blaskowski, Avon, Conn.

[73] Assignee: Combustion Engineering, Inc., Windsor, Conn.

[21] Appl. No.: 467,429

[22] Filed: Feb. 17, 1983

[51] Int. Cl.[3] ..... C10J 3/08

[52] U.S. Cl. ..... 48/197 R; 48/203; 48/210; 48/DIG. 2; 110/165 R

[58] Field of Search ..... 48/DIG. 2, DIG. 4, 87, 48/210, 77, 203, 197 R; 110/165 R

[56] References Cited

U.S. PATENT DOCUMENTS

| | | | |
|---|---|---|---|
| 2,801,158 | 7/1957 | Grossman et al. | 48/DIG. 4 |
| 3,218,998 | 11/1965 | Fairman et al. | 110/165 R |
| 4,071,329 | 1/1978 | Eales | 48/DIG. 2 |

*Primary Examiner*—Jay H. Woo
*Assistant Examiner*—Joye L. Woodard
*Attorney, Agent, or Firm*—Troxell K. Snyder

[57] ABSTRACT

A method for restoring slagging conditions in a substoichiometric slagging combustor first requires the establishment of a threshold condition below which an unacceptable risk of slag outlet pluggage exists. Upon observation of current slagging conditions below the threshold conditions, substantially pure oxygen is injected into the combustion reaction zone to increase both zone temperature and reaction rate, leading to improved slagging conditions within the slagging combustor.

5 Claims, 1 Drawing Figure

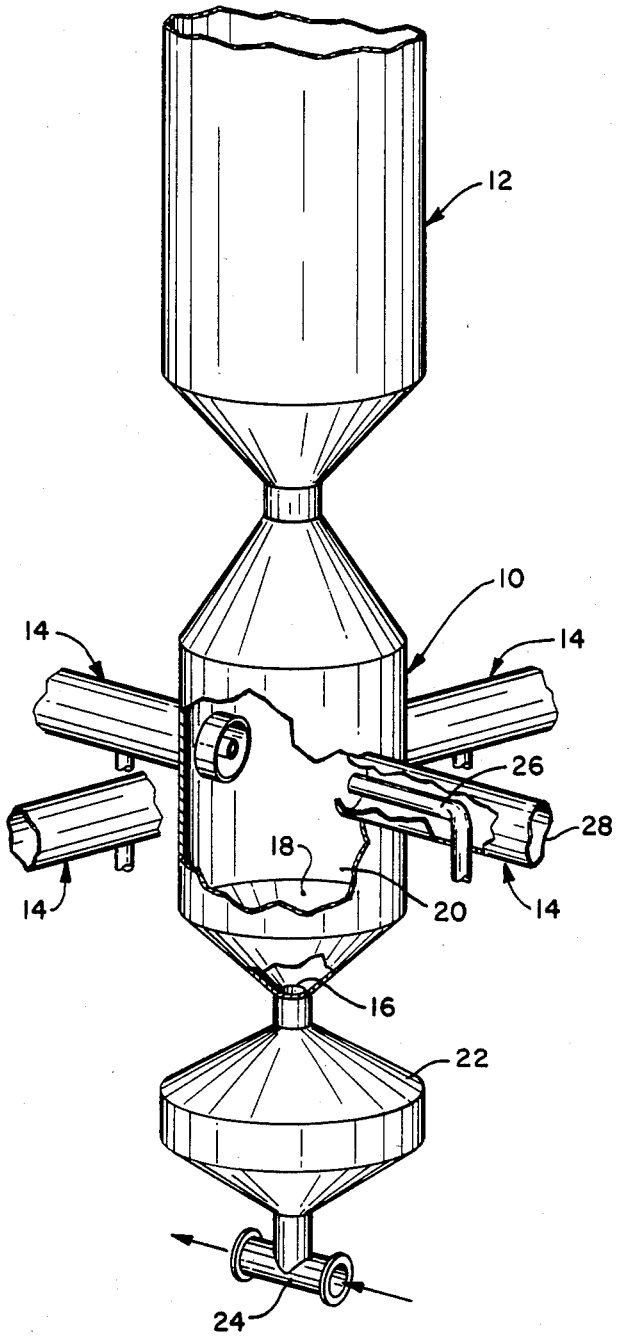
12
10
14
14
26
28
18
14
20
14
16
22
24

METHOD FOR PREVENTING PLUGGING OF A SLAG OUTLET IN A SUBSTOICHIOMETRIC SLAGGING COMBUSTOR

FIELD OF THE INVENTION

The present invention provides a method for operating a substoichiometric slagging combustor and, more particularly, a method for operating a substoichiometric slagging combustor to avoid plugging of the slag outlet.

BACKGROUND OF THE INVENTION

The problem of combusting a carbonaceous fuel which contains an inert ash component is well known to those skilled in the art of fuel conversion. This inert matter passes through the combustion reaction unchanged chemically and, depending on the temperature of the combustion reaction, will exist as a solid, a liquid, or a gas.

For combustion processes operating with combustor exit gas temperatures under 2000° F. (1093° C.), the inert component of the carbonaceous fuel will exist as a bottom ash or a fly ash, with fly ash being defined as inert material of such small size that it is carried along with the gaseous products of combustion out of the combustion reaction zone. This fly ash is undesirable in an energy conversion application such as a steam generator because of the downstream fouling of the heat absorption surfaces which may result.

One method for controlling downstream fly ash in the prior art is the use of a higher temperature combustor wherein the inert material is heated sufficiently to form a liquid known as slag. This slag deposits upon the wall of the combustion chamber, or furnace, running down the walls and exiting the furnace from a slag outlet located in the bottom. In order to maintain this slag in a free flowing state, its temperature must remain in excess of approximately 2650° F. (1454° C.), depending upon the type of fuel being converted. Should the temperature of the deposited slag fall to the lower end of the liquid regime, the slag will exhibit increased viscosity and have a tendency to build up upon the walls and floor of the combustion chamber. Such a buildup will eventually lead to a pluggage of the slag outlet and the need to immediately shut down the steam generator.

This problem is exacerbated in the case of a coal gasifier wherein the carbonaceous feed fuel is reacted substoichiometrically with air to form a combustible gas. Since in this situation it is the generated gas which is the desired end product, not the release of heat from the carbonaceous feed fuel, the combustor is operated at the lowest heat release rate consistent with continued slagging in order to maximize the yield of the product gas. As a result of this reduced heat release rate and due to the large proportion of inert material present in the combustor, especially when unreacted particulate removed downstream in the process is recycled to the combustor, there is an increased tendency which is almost chronic with such gasification systems to plug up the slag outlet.

Various methods in the prior art to address this slagging problem have included increased thickness of insulating refractory on the inner surface of the combustor vessel, increased reaction temperature due to higher air preheat, or the use of an oxidant gas with reduced nitrogen content and correspondingly increased oxygen content to reduce the temperature limiting effect of the nitrogen present in ordinary air. Such measures have proved ultimately not to solve the problem, due to materials shortcomings and economic considerations.

What is required is a simple, effective method for maintaining the slagging conditions within a substoichiometric combustor such that the overall operation of said combustor is unaffected. This method would function as required by the particular slagging conditions present within the combustion vessel and would be adaptable to a wide variety of fuel and slagging characteristics.

SUMMARY OF THE INVENTION

The method according to the present invention provides for the determination of a threshold slagging condition which serves to indicate the onset of slagging problems or pluggage in the slag outlet of a substoichiometric combustor. Operation of the slagging combustor is then observed to note any change of combustor slagging condition to a point below this determined threshold.

Upon noting such a deterioration in slagging conditions, the method according to the present invention calls for injection of substantially pure oxygen into the combustor reaction zone. The injected oxygen raises the local reaction temperature and shortens reaction time, thereby increasing the local heat release rate and providing more heat energy within the combustor for heating the slag. The higher temperature slag resulting from the increased heat release rate is of lower viscosity than cooler slag and thus flows more readily within the combustor.

The establishment of a good flow of slag within the combustor is seen as a return of the combustor slagging to a point above the determined threshold conditions, and the flow of oxygen is then ceased as not being required, at least for the present time. Should the observed slagging conditions deteriorate again, the above-described process would be repeated to again restore acceptable slagging conditions. The method according to the present invention also provides for the temporary injection of oxygen into individual burners of a multiple burner combustor on a sequential basis. This sequential injection serves to improve poor slagging conditions resulting from an unbalanced condition existing in a single unidentified burner or to generally promote improved slagging within the combustor without materially disrupting overall combustor performance.

The method also optionally includes the step of reducing the flow of air to the combustor in proportion to the flow of oxygen, providing the advantages of higher local reaction temperature due to the reduced flow of inert nitrogen, and aiding to maintain the combustion reaction in a substoichiometric state.

BRIEF DESCRIPTION OF THE DRAWING

The FIGURE shows a substoichiometric slagging combustor.

DESCRIPTION OF THE PREFERRED EMBODIMENT

The method according to the present invention is particularly adapted to be practiced in an atmospheric coal gasification vessel such as depicted in the accompanying drawing FIGURE. This coal gasification vessel consists of a slagging combustor section 10 located beneath an upper gasification, or reductor, section 12. The combustor section 10 has a plurality of burners 14 disposed about the circumference of the combustion section. A slag tap 16 is shown located in the floor 18 of the combustion section 10.

During operation a carbonaceous fuel, such as coal, is conveyed by a stream of primary air into the gasifier 10 through a fuel pipe 26. The air-to-coal mass flow ratio, dictated by the principles of dilute phase pneumatic conveyance is in the range of 1.5 to 1.7. Upon entering the combustor section 10, the coal and primary air stream is heated by the surroundings to a sufficient temperature to devolatilize and ignite the hydrocarbons present in the coal fuel.

The primary air is sufficient to react substantially all of the volatile hydrocarbon matter present within the coal fuel, however the amount of energy released is typically not sufficient to liquify the inert ash compounds present. The required additional heat is supplied by the reaction of the remaining fuel carbon with additional oxygen in a secondary air stream supplied through a conduit 28 surrounding the central fuel pipe 26. This additional heat release must be sufficient to liquify the inert material present in the fresh coal feed as well as in any inert material present in the particulate recycle.

Rapid heatup of the inert material is essential to good slagging as the high temperature region resulting from the coal-air reactions discussed above does not extend beyond the reaction zone due to heat loss and the occurrence of endothermic gasification reactions. Inert material not liquified within the reaction zone exits the combustor section 10 as solidified ash particles or, less preferably, deposits on the combustor wall 20 or floor 18 as a gob of soft, sticky and immobile slag.

Properly heated inert material which is completely liquified in the high temperature reaction zone, will remain as a liquid through a moderate amount of cooling before and after depositing on the inner wall 20 of the combustor section 10. This liquid slag drips downward under the influence of gravity to exit through the slag outlet 16 in the floor 18.

A slag collection tank 22 and a slag removal means 24, such as the venturi depicted in the drawing FIGURE, complete the major components of the slag disposal system. Hot molten slag exiting the slag outlet 16 falls into the slag collection tank 22 wherein the hot slag is quenched in a water bath and solidified. The solidified slag is removed to a slag dewatering tank (not shown) for final disposal.

The method according to the present invention will be best understood by considering the following examples which are to be taken in an illustrative, and not a limiting, sense.

EXAMPLE 1

A two-stage slagging coal gasifier is constructed with a combustor section 10 and a reductor section 12 as depicted in the accompanying drawing. During the initial startup checkout, the combustor section is operated under a wide variety of stoichiometric and fuel feed rate variations. Slagging conditions within the combustor section 10 are observed directly, through a viewport located in the combustor section wall 20, or indirectly by viewing the quality of the slag exiting the slag outlet 16 through a viewport located in the slag collection tank 22.

A threshold slagging condition is determined as a result of these observations. The threshold slagging condition is defined as a slagging condition below which an unacceptably high risk of pluggage of the slag outlet 16 exists. Continued operation of the combustor section 10 below this threshold slagging condition results in an eventual pluggage of the slag outlet 16.

A typical threshold slagging condition within the combustor section 10, as observed through a viewport (not shown) in the combustor wall 20, is a significant buildup of tacky slag upon the walls 20 and the floor 18 of the combustor section 10. This slag buildup, on the order of several inches of viscous slag material, would also be seen as a reduction in the free flow area of the slag outlet 16. Slagging conditions within the combustor section 10 which are below this threshold condition, exemplified by thicker buildup of slag material on the walls 20 or the floor 18, would likely result in an eventual pluggage of the slag outlet 16. Slagging conditions above this threshold condition, exemplified by a thinner coating of less viscous slag material on the walls 20 and the floor 18, have a significant likelihood of not resulting in any slagging pluggage or other problems.

An alternative means of determining the slagging conditions within the combustor section 10 is the observation of the state of the slag flowing from the slag outlet 16 into the slag collection vessel 22. The threshold slagging condition occurs when the slag flowing from the slag outlet 16 into the slag collection tank 22 is observed as a slightly viscous, but still freely flowing liquid. Slagging conditions below this threshold condition would be observed as very thick streamers or lumps of slag material dropping unevenly into the slag collection tank 22. This evidence of uneven or reluctant slag flow from the combustor section 10 indicates the approach of a partial or complete blockage in the slag outlet 16. Slagging conditions above the threshold slagging condition as observed from a viewport in the slag collection tank 22 would be seen as a relatively inviscid, free flowing liquid exiting the combustor section 10 without impediment.

Once this slagging threshold is determined, the gasification system would be operated to produce product gas for the particular application involved. During the course of operation, the slagging conditions within the combustor section 10 would be observed continuously to note any approach near the determined threshold condition. Such an approach is relatively slow due to the large scale of the components involved, usually on the order of several minutes. With the noting of an approach toward the threshold slagging condition, the plant operator would initiate the method according to the present invention in order to re-establish slagging conditions above the determined threshold condition, thus avoiding the possibility of a slag outlet pluggage.

According to the present invention, substantially pure oxygen is introduced into the combustion zone as a part of the primary air stream which conveys the carbonaceous fuel into the combustor section 10 by means of a fuel pipe 26. By introducing the oxygen into the primary air stream, the oxygen is mixed thoroughly with the carbonaceous fuel and will be directly injected into the reaction zone. Substantially pure oxygen is herein defined as a gas containing approximately 95% or more pure oxygen gas by volume. The remainder of this gas is preferably a nonreactive gas, such as nitrogen, and does not contain any combustible gaseous material.

The amount of oxygen admitted into the combustor section 10 according to the present invention will vary depending on the particular operating conditions and the particular design of the gasification system. The injection of additional oxygen into the reaction zone increases the amount of free oxygen available early in the combustion process, increasing both the reaction rate and reaction zone temperature. This increased reaction temperature is sufficient to result in a higher temperature liquid slag produced within the reaction zone, as well as an increased surface temperature of the deposited slag on the walls 20 and floor 18. Overall combustor stoichiometry is maintained by reducing the flow of secondary air oxygen into the combustor 10 by an amount proportional to the flow of injected oxygen. The corresponding reduction in the amount of nitrogen present in the reaction zone also increases zone temperature and reaction rate.

The increased temperature of the produced and already deposited slag decreases slag viscosity, thereby improving slagging conditions within the combustor section 10. The injection of oxygen is maintained until current slagging conditions are observed to again be in excess of the threshold condition. At this point in time the injection of oxygen is ceased and combustor slagging conditions again monitored to note any approach toward the threshold condition.

EXAMPLE 2

In this situation, the slagging coal gasifier vessel is again a two-stage unit as shown in the accompanying drawing FIGURE. The first, or combustor stage 10, has a plurality of burners 14 disposed circumferentially in the wall 20. Each burner 14 contains a central fuel pipe 26 for conveying the carbonaceous fuel pnuematically into the interior of the combustor section 10, and an outer secondary air conduit 28 for supplying the additional combustion air to the combustion reaction zone.

Firing and slagging are in general similar to that discussed in Example 1 above, except for the possibility that a slight malfunction or imbalance in an individual burner 14 can result in a local area of poor slagging within the combustor section 10. Determination of the slagging threshold for this particular unit proceeds as discussed in Example 1. Slag flow is monitored to determine the approach of the current slagging conditions to that of the determined threshold condition for the purpose of initiating the method according to the present invention.

In this alternative embodiment according to the present invention, substantially pure oxygen is injected sequentially into each individual burner 14 through the central fuel pipe 26. The increased local stoichiometry within the reaction zone of each individual burner causes a local increase in temperature. In this manner slagging is improved within corresponding regions in the combustor section 10 in a sequential fashion. Overall combustor slagging is therefore improved with a limited impact on overall combustor stoichiometry, temperature, or hot gas output. Sequential injection of substantially pure oxygen is continued until the observed slagging conditions have improved sufficiently to allow discontinuance.

EXAMPLE 3

It is desired to operate the slagging coal gasifier of Example 2 at an operating point which, if unaltered, would result in slagging conditions below the determined threshold condition. In order to allow this operation, oxygen is continuously injected sequentially into the burners 14, thus acting to improve slagging conditions for each region within the combustor section 10. In this manner, while overall combustor slagging conditions remain below the threshold condition, individual zones within the combustor which correspond to the individual burners 14 will experience improved slagging for a period of time sufficient to avoid slag outlet sluggage.

CONCLUSION

The method according to the present invention disclosed in the above Examples shows a simple, effective method for temporarily improving the slagging conditions within a substoiciometric slagging combustor. While the disclosed Examples show the use of such a method in conjunction with a two-stage slagging coal gasifier, it will be understood by one skilled in the art that this method would be equally applicable to a wide variety of substoichiometric slagging combustor applications.

I claim:

1. A method for preventing plugging of the slagging outlet by excessively viscous slag material in a slagging, substoichiometric combustor reacting a carbonaceous fuel with air, said air including a primary air stream and a secondary air stream, said primary air stream pneumatically conveying said fuel into said combustor, comprising the steps of:

observing the slagging conditions within said combustor for determining a threshold condition, wherein continued operation of said combustor under slagging conditions below the threshold condition results in the occurrence of an unacceptable likelihood of plugging of the slag outlet;

monitoring the current slagging conditions within said combustor to ascertain if the current condition is below the determined threshold condition;

injecting substantially pure oxygen, responsive to the monitoring step, into said primary air stream for increasing, at least locally, the reaction temperature within said combustor, thereby reducing slag viscosity within said combustor; and ceasing the injection of the substantially pure oxygen upon improvement of the current slagging condition above the determined threshold condition.

2. The method as recited in claim 1, wherein the step of injecting substantially pure oxygen further includes the step of reducing the flow rates of said primary air and said secondary air by amounts proportional to the flow of the injected oxygen for maintaining a substantially constant stoichiometry within said combustor.

3. The method as recited in claim 1, wherein said combustor has a plurality of burners for introducing said fuel and said air into said combustor, and wherein the step of injecting substantially pure oxygen into said primary air stream is performed by sequentially injecting the substantially pure oxygen into the individual burners.

4. The method as recited in claim 3, further comprising the step of reducing the flow of air to the burner currently being injected with oxygen by an amount proportional to the oxygen flow rate for maintaining a substantially constant stoichiometry within said combustor.

5. A method for preventing the blockage by excessively viscous slag material of the slag tap in a two-stage atmospheric coal gasifier having a lower slagging stage, said lower stage having a floor with a slag tap opening disposed therein, at least one burner for introducing coal and air into the interior of said lower stage in substoichiometric proportions, and means for introducing into said lower stage at least a portion of any solid matter collected from the produced gas stream exiting said gasifier, comprising the steps of:

observing the flow of slag from said slag tap to determine if the slag flow is in a viscous, irregular state or in a relatively inviscid, smooth-flowing state;

injecting a quantity of substantially pure oxygen gas into the reaction zone of said coal and said air, responsive to a current observation of a viscous irregular state of slag flow, for increasing the reaction temperature and heat release rate of said coal within said lower stage; and ceasing the injection of substantially pure oxygen responsive to an observed change of the state of the slag flow from viscous or irregular to relatively inviscid and smooth flowing.

* * * * *